US006604632B2

(12) United States Patent
Weder

(10) Patent No.: US 6,604,632 B2
(45) Date of Patent: Aug. 12, 2003

(54) SHIPPING PACKAGE FOR A FLORAL GROUPING

(75) Inventor: Donald E. Weder, Highland, IL (US)

(73) Assignee: Southpac Trust Int'l. Inc.

( * ) Notice: Subject to any disclaimer, the term of this patent is extended or adjusted under 35 U.S.C. 154(b) by 189 days.

(21) Appl. No.: 09/872,281

(22) Filed: May 30, 2001

(65) Prior Publication Data

US 2002/0195365 A1 Dec. 26, 2002

Related U.S. Application Data

(60) Provisional application No. 60/208,366, filed on May 31, 2000.

(51) Int. Cl.[7] ..... B65D 85/50
(52) U.S. Cl. ..... 206/423; 206/460
(58) Field of Search ..... 206/423, 460, 206/497, 813; 53/397, 410, 475; 47/72; 229/87.01, 87.05

(56) References Cited

U.S. PATENT DOCUMENTS

| | | | |
|---|---|---|---|
| 1,064,813 | A | 6/1913 | Bloomberg |
| 1,979,771 | A | 11/1934 | Potter |
| 2,165,539 | A | 7/1939 | Dahlgren |
| 2,209,778 | A | 7/1940 | Krasowski |
| 2,373,634 | A | 4/1945 | Wagner |
| 2,578,583 | A | 12/1951 | O'Brien |
| 2,612,989 | A | 10/1952 | Harrison |
| 2,664,670 | A | 1/1954 | Mulford |
| 2,707,352 | A | 5/1955 | Fischer |
| 2,744,624 | A | 5/1956 | Hoogstoel et al. |
| 2,774,187 | A | 12/1956 | Smithers |
| 2,871,080 | A | 1/1959 | Shelly |
| 3,022,605 | A | 2/1962 | Reynolds |
| 3,113,673 | A | 12/1963 | Stein |
| 3,389,784 | A | 6/1968 | Hendricks |
| 3,431,706 | A | 3/1969 | Stuck |
| 3,488,022 | A | 1/1970 | Vittori |
| 3,513,895 | A | 5/1970 | Lattuca |
| 3,657,840 | A | 4/1972 | Benoist |
| 3,734,280 | A | 5/1973 | Amneus et al. |
| 3,869,828 | A | 3/1975 | Matsumoto |
| 3,883,990 | A | 5/1975 | Stidolph |
| 3,924,354 | A | 12/1975 | Gregoire |
| 3,962,503 | A | 6/1976 | Crawford |
| 4,053,049 | A | 10/1977 | Beauvais |
| 4,189,868 | A | 2/1980 | Tymchuck et al. |
| 4,216,620 | A | 8/1980 | Weder et al. |

(List continued on next page.)

FOREIGN PATENT DOCUMENTS

| | | |
|---|---|---|
| AU | 192843 | 11/1957 |
| DE | 8905250.1 | 10/1989 |
| EP | 0050990 | 5/1982 |
| FR | 1393725 | 2/1965 |
| FR | 2137325 | 12/1972 |
| FR | 2221936 | 10/1974 |
| FR | 2467796 | 11/1979 |
| FR | 2619698 | 8/1987 |
| GB | 206813 | 11/1913 |
| JP | 4352664 | 12/1992 |
| NL | 8101464 | 10/1982 |
| WO | WO 96/37133 | 11/1996 |

*Primary Examiner*—Luan K. Bui
(74) *Attorney, Agent, or Firm*—Dunlap Codding & Rogers

(57) ABSTRACT

A shipping package for a floral grouping including a sheet of material bonded to a support member and wrapped upwardly and gathered at a portion above the floral grouping to enclose the floral grouping. A bonding material joins the gathered portion, and a plurality of perforations in the sheet of material provides for the detachment of a detachable portion above the floral grouping. The support member can be provided as a foldable member to form an outer enclosure about the floral grouping with the sheet of material forming a substantially water tight enclosure between the floral grouping and the outer enclosure.

9 Claims, 6 Drawing Sheets

U.S. PATENT DOCUMENTS 4,248,347 A 2/1981 Trimbee
4,396,120 A 8/1983 Morita
4,400,910 A 8/1983 Koudstaal et al.
4,413,725 A 11/1983 Bruno et al.
4,470,508 A 9/1984 Yen
4,608,283 A 8/1986 White
4,621,733 A 11/1986 Harris
4,640,079 A 2/1987 Stuck
4,646,470 A 3/1987 Maggio
4,733,521 A 3/1988 Weder et al.
4,741,440 A 5/1988 Harris
4,773,182 A 9/1988 Weder et al.
4,801,014 A 1/1989 Meadows
4,819,803 A 4/1989 Neiser
4,835,834 A 6/1989 Weder
4,882,893 A 11/1989 Spencer et al.
4,980,209 A 12/1990 Hill
5,092,465 A 3/1992 Weder et al.
5,105,599 A 4/1992 Weder
5,148,918 A 9/1992 Weder et al.
5,195,637 A 3/1993 Weder
5,199,242 A 4/1993 Weder et al.
5,235,782 A 8/1993 Landau
5,239,775 A 8/1993 Landau
5,240,109 A 8/1993 Weder et al.
5,255,784 A 10/1993 Weder et al.
5,265,727 A 11/1993 Anderson
5,311,992 A 5/1994 Weder et al.
5,407,072 A 4/1995 Weder et al.
5,411,137 A 5/1995 Weder et al.
5,564,567 A 10/1996 Weder
5,687,845 A * 11/1997 Weder ..... 206/423
6,131,332 A * 10/2000 Garcia ..... 47/72
6,357,591 B1 * 3/2002 Garcia et al. ..... 206/423

* cited by examiner

SHIPPING PACKAGE FOR A FLORAL GROUPING

CROSS-REFERENCE TO RELATED APPLICATIONS

This application claims the benefit of U.S. Provisional Application Serial No. 60/208,366, filed May 31, 2000, and expressly incorporated herein by reference.

BACKGROUND OF THE INVENTION

The present invention relates generally to the field of packaging, and more particularly, but not by way of limitation, to a shipping package for protection of a floral grouping during shipping and handling thereof.

DETAILED DESCRIPTION OF THE INVENTION

Figure 1:
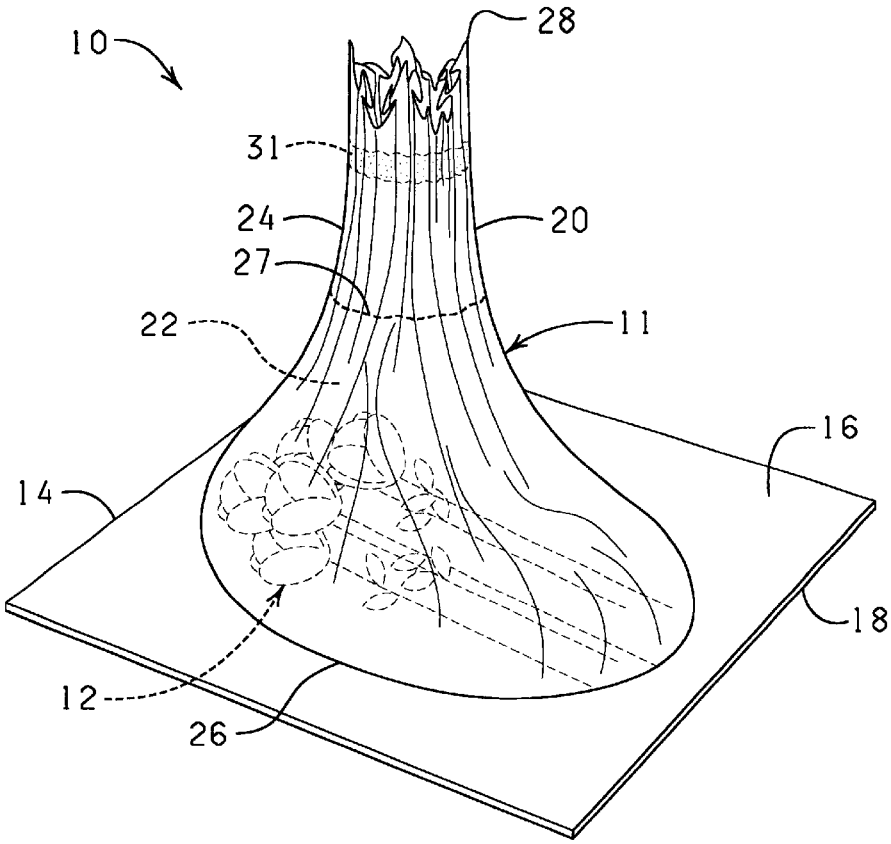
FIG. 1 is a perspective view of a packaging assembly includes a floral grouping disposed in a shipping package in accordance with the present invention.
Figure 2:
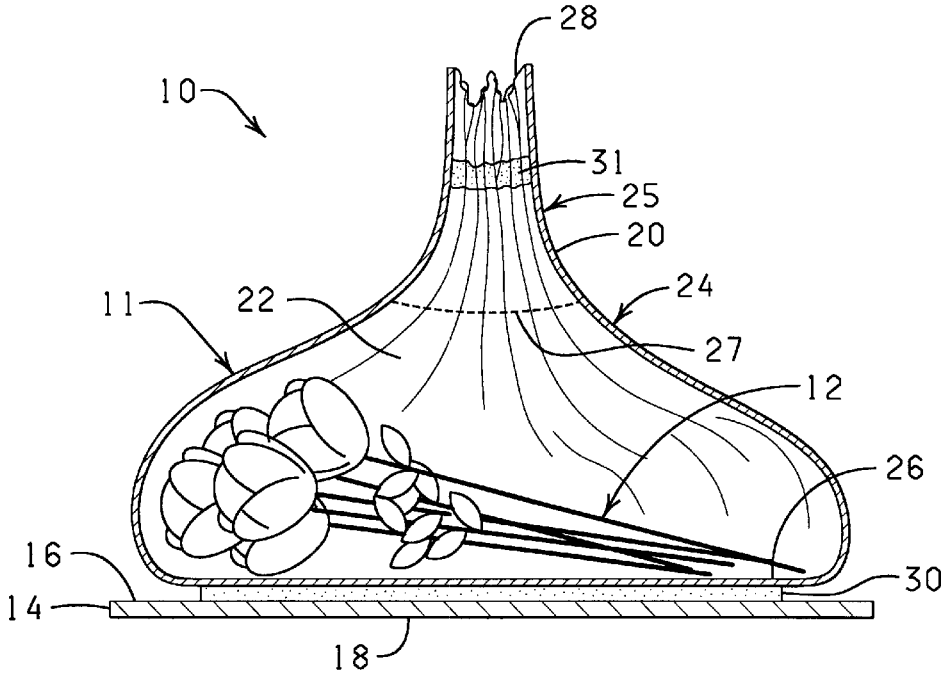
FIG. 2 is a cross-sectional view of the packaging assembly of FIG. 1.
Figure 3:
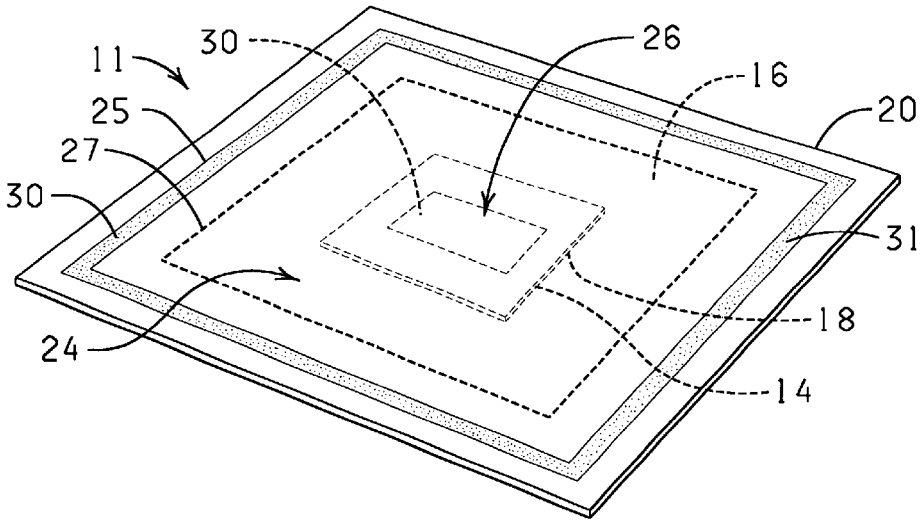
FIG. 3 is a perspective view of the shipping package of the packaging assembly of FIG. 1 in a flattened, unwrapped position.

Referring now to the drawings, and more particularly to FIGS. 1–3, shown therein is a packaging assembly 10 which includes a shipping package 11 and a floral grouping 12. The shipping package 11 includes a support member 14 having an upper support surface 16 and a lower surface 18, and a sheet of material 20 attached to the upper support surface 16 of the support member 14. The sheet of material 20 is constructed to enclose the floral grouping 12 and provide a substantially water tight enclosure.

The sheet of material 20 can be provided with a peripheral edge defining a generally flat, rectangular sheet of material, but can also be provided with any shape, being geometric, non-geometric, asymmetrical and/or fanciful, as long as the sheet of material functions in accordance with the present invention. The sheet of material 20 may be, by way of example, but not by way of limitation, circular, conical, combinations thereof, or any other shape, as long as the sheet of material 20 functions as described herein.

The sheet of material 20 can also be provided with side ventilation holes (not shown), or the sheet of material 20 can be made from gas permeable or impermeable materials. When multiple sheets of material 20 are used together, they may be connected together or laminated, or can comprise separate layers. Finally, it will be appreciated that the sheet of material 20 can be substantially flat or angled such that when disposed about the floral grouping 12 and any other item contained with the floral grouping 12 and enclosed by the sheet of material 20, the sheet of material 20 may extend a distance upwardly beyond the floral grouping 12. Any thickness of the sheet of material 20 may be utilized in accordance with the present invention as long as the sheet of material 20 can be disposed about the floral grouping 12 as described herein. Preferably, the sheet of material 12 is within a thickness range of about 0.1 mil to about 30 mils.

The sheet of material 20 can be constructed from any suitable material that is capable of being disposed about the floral grouping 12. Examples of material suitable for use are paper (untreated or treated in any manner), cellophane, foil, polymer film, fiber (woven or non-woven or synthetic or natural), cloth (woven or non-woven or natural or synthetic) burlap, or any combinations thereof.

The term polymer film when used herein includes synthetic polymers such as polypropylene or naturally occurring polymers such as cellophane. A polymer film is relatively strong and not as subject to tearing as compared to paper or foil material. The sheet of material 20 can also be constructed from a cling material such as, but not limited to, Cling Wrap made by Glad, First Brands Corporation, Danbury, Conn.

The sheet of material 20 may vary in color. Further, the sheet of material 20 can consist of designs which are printed, etched, and/or embossed; in addition, the sheet of material 20 may have various colorings, coatings, flockings and/or metallic finishes, or be characterized totally or partially by pearlescent, translucent, transparent, iridescent, or the like characteristics. Each of the above-named characteristics may occur alone or in combination. Moreover, each surface of the sheet of material 20 can vary in the combinations of such characteristics.

The sheet of material 20 can also be constructed from one or more sheets of polymer film or combination of one or more sheets of polymer films and a sheet of foil wherein at least an outer surface can be provided with a pattern printed or embossed pattern thereon. The sheets of material employed to produce the sheet of material 20 can be connected together or laminated or may be separate layers. While specific embodiments have been described, they are illustrative and not limiting of the scope of materials contemplated as being well suited for use in the sheet of material 20.

The floral grouping 12 can be cut fresh flowers, artificial flowers, a single flower or other fresh and/or artificial plants or other floral materials and may include other secondary plants and/or ornamentation or artificial or natural materials which add to the aesthetics of the overall floral grouping 12. Further, the floral grouping 12 may comprise a growing potted plant having a root portion as well. However, it will be appreciated that the floral grouping may consist of only a single bloom or only foliage, or a botanical item, or a propagule. The term "floral grouping" as used herein includes "floral arrangement."

The floral grouping 12 is disposed within a cavity 22 (FIGS. 1–2) provided by an upward folding of an outer portion 24 of the sheet of material 20 to form a wrapper with an upstanding concave characteristic shape. FIG. 3 shows the shipping package 11 of the packaging assembly 10 of FIG. 1, in an unwrapped condition prior to wrapping of the floral grouping 12, wherein the sheet of material 20 is in a flattened, unwrapped position. As best viewed in FIG. 3, a medial portion 26 of the sheet of material 20 is attached at the lower surface 18 thereof to the upper support surface 16 of the support member 14 to anchor the sheet of material 20 to the support member 14. The medial portion 26 of the sheet of material 20 is thus preferably centrally disposed relative to the support member 14, and the outer portion 24 extends radially therefrom in a manner surrounding the medial portion 26.

FIG. 2 shows a manner of attachment of the medial portion 26 of the sheet of material 20 to the support member 14 by a bonding material 30 interposed therebetween. Fixing the sheet of material 20 to the support member 14 facilitates wrapping of the outer portion 24 of the sheet of material 20 upwardly around the floral grouping 12 and gathering of a distal portion 28 of the sheet of material 20 in order to protectively and/or decoratively enclose the floral grouping 12.

The distal portion 28 of the sheet of material 20 can be gathered a distance above the floral grouping 12 and closed to fully enclose the floral grouping 12 within the cavity 22 provided by the upwardly folded sheet of material 20. A bonding material 31 can be used to retain the distal portion 28 in the closed position to provide a decorative appearance and/or a substantially water tight protective wrapping of the sheet of material 20 about the floral grouping 12. By wrapping the sheet of material 20 in this manner so as to enclose the floral grouping 12, the support member 14 and the sheet of material 20 support the floral grouping 12 in a desired position to prevent movement of the floral grouping 12 relative to the support member 14 during shipping and handling of the packaging assembly 10.

The term "bonding material" when used herein includes an adhesive or a cohesive. Where the bonding material is a cohesive, a suitable cohesive material must be placed on the adjoining surface for bondingly contacting and bondingly engaging the cohesive material. The term "bonding material" also includes materials which are heat sealable wherein adjacent portions of the material are brought into contact and then heated to affect the seal. The term "bonding material" also includes materials which are sonically sealable and vibrationally sealable, as well as heat sealing lacquer which may be applied to the sheet of material.

The term "bonding material" when used herein also includes any type of material or member which can be used to affect the bonding or connecting of the adjacent portions of the material or sheet of material to affect the connection or bonding described herein. The term "bonding material" also includes ties, labels, bands, ribbons, strings, tape, staples or combinations thereof. Some of the bonding materials would secure the ends of the sheet of material 20 while other bonding material may bind the circumference of the gathered portion of the wrapper that is formed by the sheet of material 20.

The outer portion 24 of the sheet of material 20 has a detachable portion 25 to provide access to the floral grouping 12 while leaving the sheet of material 20 anchored to the support member 14. That is, while the remaining outer portion 24 is disposed about the floral grouping 12 and the medial portion 26 is attached to the support member 14. The detachable portion 25 can be delineated by a plurality of perforations 27 along which the detachable portion 25 is detached from the remaining outer portion 24 of the sheet of material 20.

Following are several versions of packaging assemblies constructed in accordance with the present invention described hereinabove.

Figure 4:
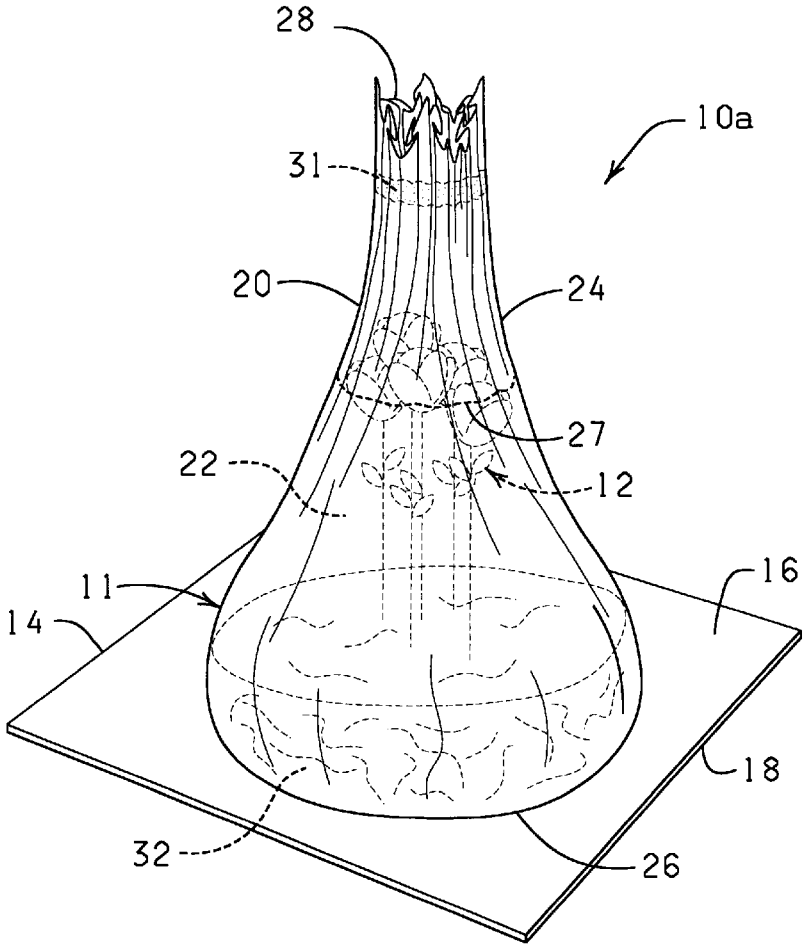
FIG. 4 is a perspective view of another embodiment of a packaging assembly including a bed of growth medium supporting the floral grouping.
Figure 5:
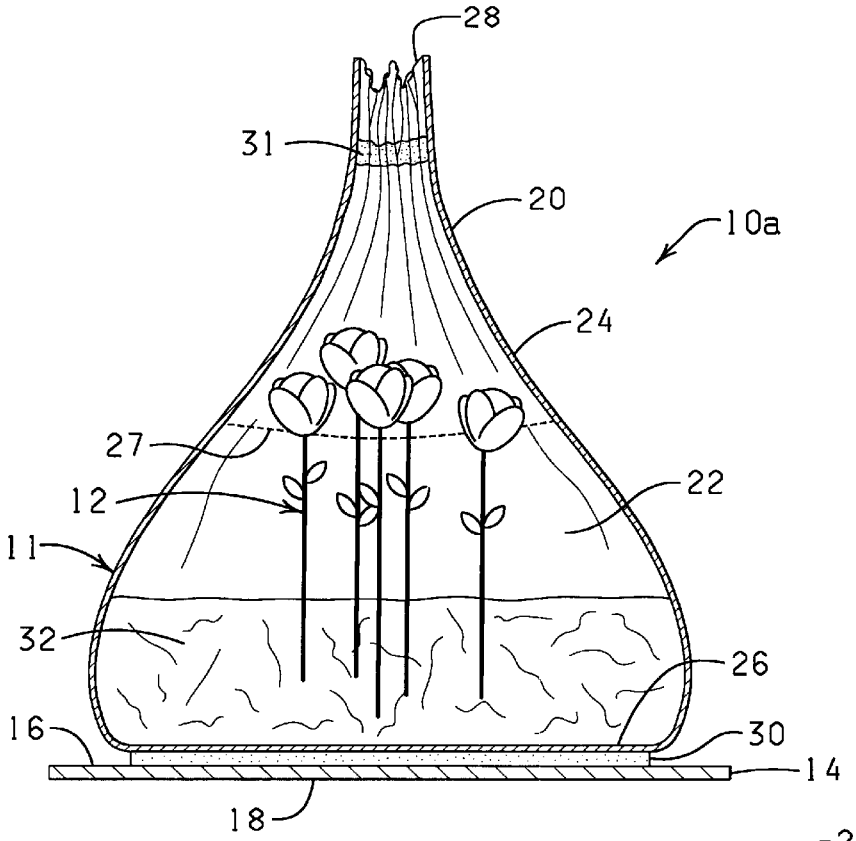
FIG. 5 is a cross-sectional view of the packaging assembly of FIG. 4.

FIGS. 4 and 5

FIGS. 4 and 5 show a packaging assembly 10*a* which is substantially similar to the packaging assembly 10 with the exception that the packaging assembly 10*a* includes a bed of growing medium 32 within the shipping package 11 for supporting the floral grouping 12. The medial portion 26 of the sheet of material 20 is bonded to the support member 14 and the outer portion 24 is folded upwardly and joined at the distal portion 28 by the bonding material 31 to enclose the floral grouping 12 and the bed of growth medium 32 contained within the cavity 22 of the wrapper formed by the sheet of material 20. The bed of growing medium 32 can be a material suited to the establishment and support of the floral grouping 12 root system such as, but not limited to, potting soil.

By wrapping the sheet of material 20 so as to enclose the floral grouping 12 and the bed of growing medium 32, the support member 14 and the sheet of material 20 laterally support the bed of growing medium 32 so the floral grouping 12 is supported in an upright position to prevent the floral grouping 12 from toppling during shipping and handling of the packaging assembly 10*a*. The wrapper provided by the sheet of material 20 also provides a substantially water tight enclosure. By interposing the sheet of material 20 between the floral grouping 12 and the support member 14, the water tight enclosure of the sheet of material 20 isolates the support member 14 from the moisture associated with the floral grouping 12 in the cavity 22. Hence, it is unnecessary to make the support member 14 water resistant.

Figure 6:
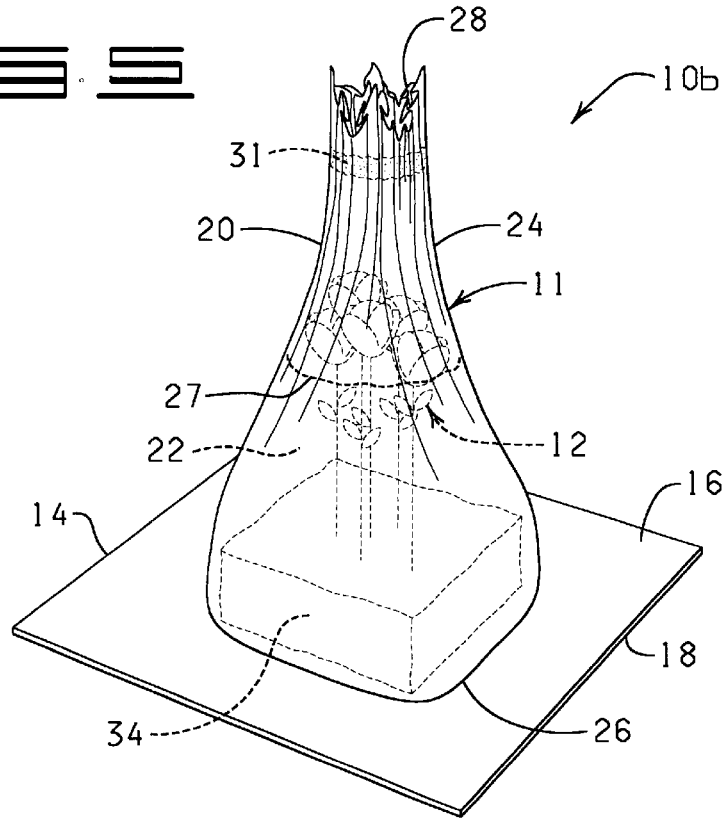
FIG. 6 is a perspective view of another embodiment of a packaging assembly including a floral holding material supporting the floral grouping.
Figure 7:
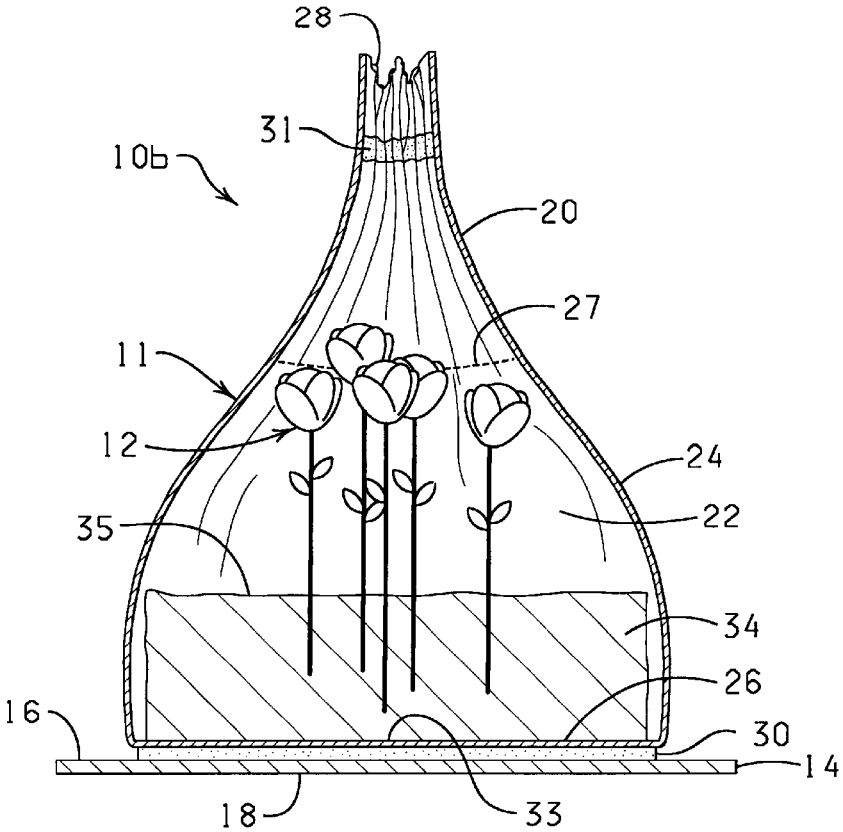
FIG. 7 is a cross-sectional view of the packaging assembly of FIG. 6.

FIGS. 6 and 7

FIGS. 6 and 7 show a packaging assembly lob which is substantially similar to the packaging assembly 10 with the exception that the packaging assembly 10*b* includes a floral holding material 34 for supporting the floral grouping 12 within the shipping package 11. The floral holding material 34 has a lower end 33 supported by the support member 14 with the sheet of material 20 interposed therebetween, and an upper end 35 which receivingly supports the floral grouping 12. The medial portion 26 of the sheet of material 20 is bonded to the support member 14. The outer portion 24 of the sheet of material 20 is wrapped about to enclose the floral grouping 12 and the floral holding material 34 contained within the cavity 22 of the wrapper formed by the sheet of material 20. The distal end 28 of the sheet of material 20 is joined by the bonding material 31. The floral holding material 34 can be a moisture-retaining member such as, but not limited to, a foam block.

By wrapping the sheet of material 20 so as to enclose the floral grouping 12 and the floral holding material 34, the support member 14 and the sheet of material 20 support the floral grouping 12 and the floral holding material 34 in an upright position to prevent the floral holding material 34 and the floral grouping 12 from toppling during shipping and handling of the packaging assembly 10*b*. The wrapper provided by the sheet of material 20 also provides a substantially water tight enclosure. By interposing the sheet of material 20 between the floral grouping 12 and the support member 14, the water tight enclosure of the sheet of material 20 isolates the support member 14 from the moisture associated with the floral grouping 12 in the cavity 22. Hence, it is unnecessary to make the support member 14 water resistant.

Figure 8:
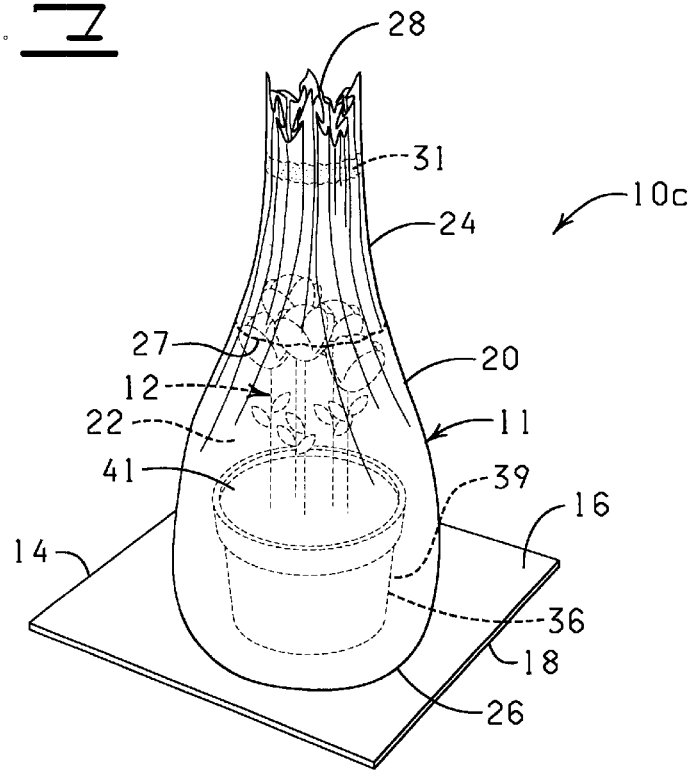
FIG. 8 is a perspective view of another embodiment of a packaging assembly including a flower pot supporting the floral grouping.
Figure 9:
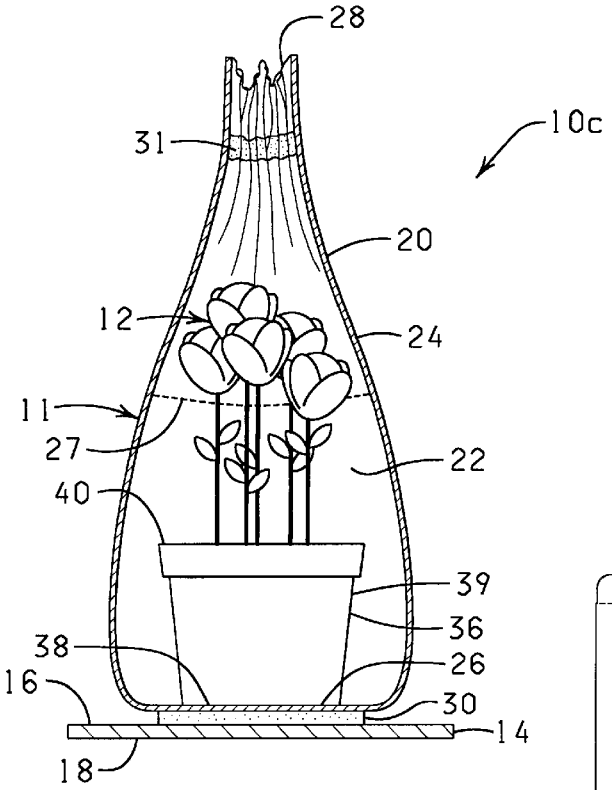
FIG. 9 is a cross-sectional view of the packaging assembly of FIG. 8.

FIGS. 8 and 9

FIGS. 8 and 9 show a packaging assembly 10*c* which is substantially similar to the packaging assembly 10 with the exception that the packaging assembly 10*c* includes a container such as a flower pot 36 within the shipping package 11. The medial portion 26 of the sheet of material 20 is bonded to the support member 14 and the outer portion 24 of the sheet of material 20 is wrapped about to enclose the floral grouping 12 and the flower pot 36 contained within the cavity 22 of the wrapper formed by the sheet of material 20. The distal end 28 of the sheet of material 20 is joined by the bonding material 31.

The flower pot 36 has a substantially closed lower end 38 adjacent to the medial portion 26 of the sheet of material 20, the lower end 38 supported on the support member 14 so that the flower pot 36 achieves a substantially upright position. The flower pot 36 furthermore has an upstanding body 39 and a terminating rim 40 forming an open upper end 41. The floral grouping 12 is disposed in the open upper end 41 and is supported thereby in the upright position. Alternatively, the flower pot 36 can contain the bed of growing medium 32 (FIG. 5) and/or the floral holding material 34 (FIG. 7) which, in turn, supports the floral grouping 12 in the upright position.

By wrapping the sheet of material 20 so as to enclose the floral grouping 12 and the flower pot 36, the support member 14 and the sheet of material 20 support the floral grouping 12 and the flower pot 36 in the upright position to prevent the flower pot 36 and the floral grouping 12 from toppling during shipping and handling of the packaging assembly 10*c*. The wrapper provided by the sheet of material 20 also provides a substantially water tight enclosure. By interposing the sheet of material 20 between the floral grouping 12 and the support member 14, the water tight enclosure of the sheet of material 20 isolates the support member 14 from the moisture associated with the floral grouping 12 in the cavity 22. Hence, it is unnecessary to make the support member 14 water resistant.

FIGS. 10–12

Figure 10:
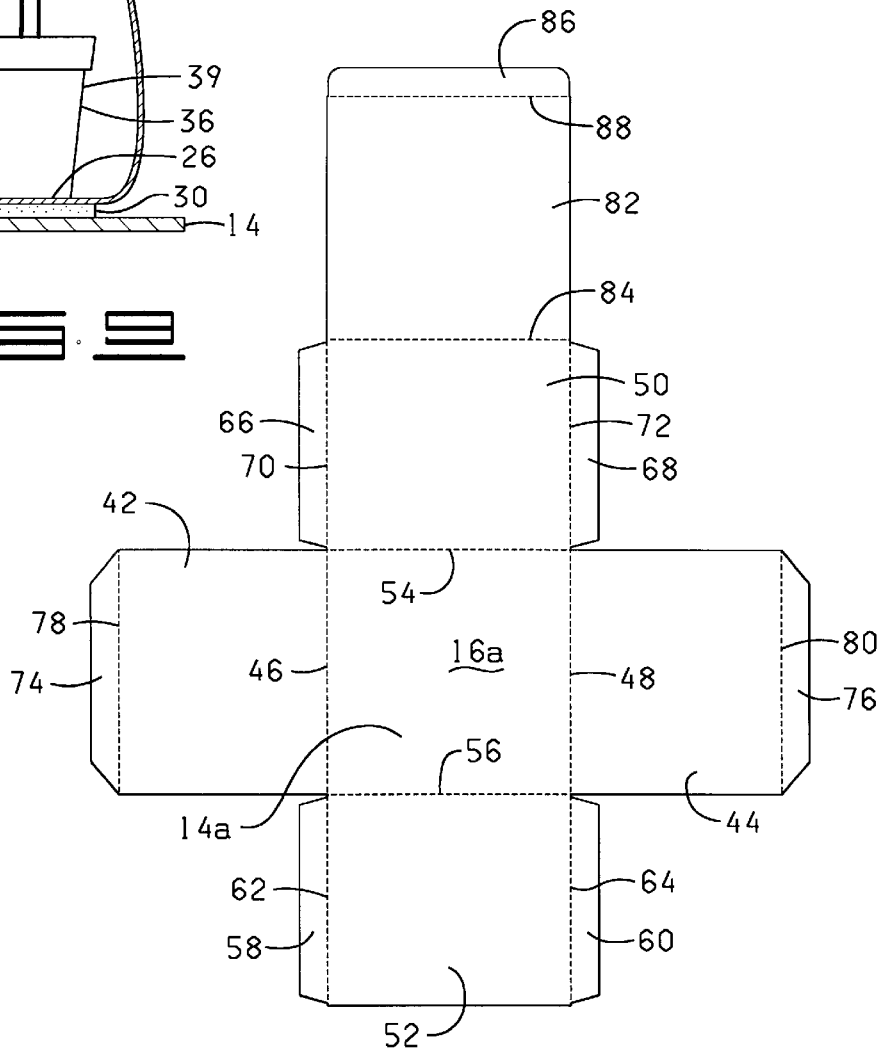
FIG. 10 is a perspective view of a support member with extending portions that are foldable to provide an enclosure about the floral grouping.

The support member 14 has been illustrated as a substantially rectangular planar member having an upper support surface 16 attached to the medial portion 26 of the sheet of material 20 for anchoring of the wrapper formed by the upwardly folded and joined sheet of material 20. The support member 14 can also have extended positions to provide a supporting structural enclosure about the wrapper formed by the sheet of material 20. For example, FIG. 10 generally illustrates a support member 14*a* having a substantially rectangular central portion with an upper support surface 16*a* and a plurality of foldable portions extending therefrom, the foldable portions delineated by folding lines. The folding lines facilitate the folding of one portion relative to adjacent portions, the folding lines being provided by features such as, but not limited to, score lines, creases, perforations, and the like within the support member 14*a*.

Figure 11:
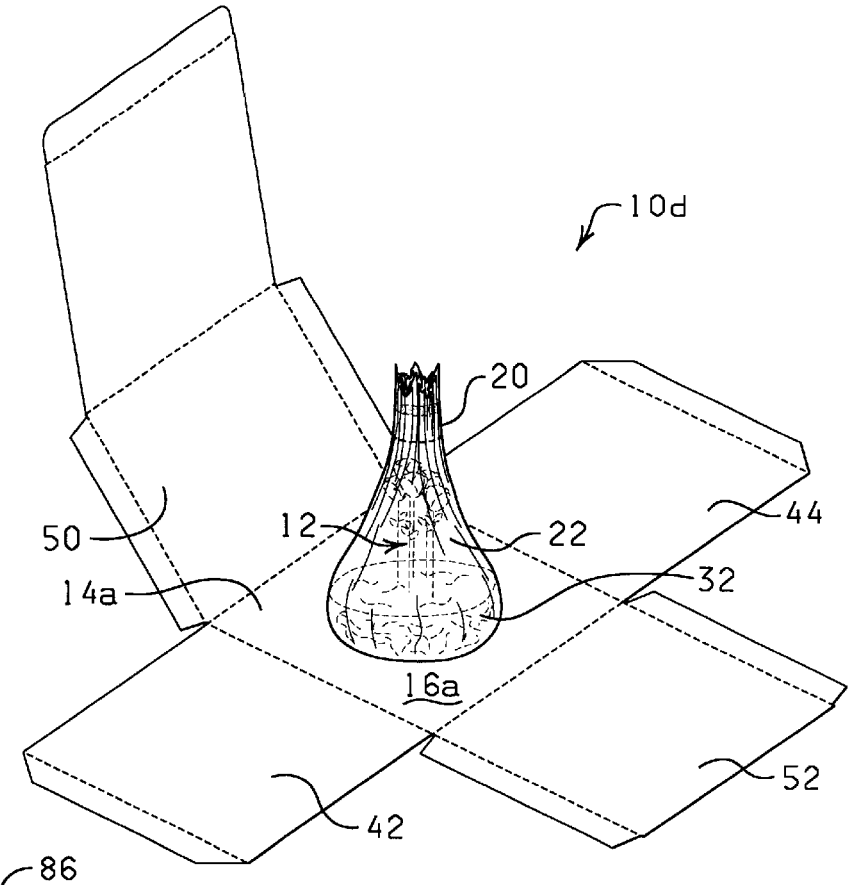
FIG. 11 is a perspective view of a packaging assembly including the support member of FIG. 10 with the support member shown in a partially-folded condition.

More particularly, surrounding the upper support surface 16*a* of the support member 14*a* are opposing wall portions 42, 44 which are foldable toward the upper support surface 16*a* along fold lines 46, 48 respectively. Similarly, opposing wall portions 50, 52 are foldable along fold lines 54, 56, respectively. The wall portions 42, 44, 50, 52 can be folded substantially orthogonal to the upper support surface 16*a* so as to circumscribe the sheet of material 20 that is anchored to the upper support surface 16*a* in the manner discussed hereinbelow. FIG. 11 illustrates a partial folding of the wall portions 42, 44, 50, 52 in a packaging assembly 10*d* wherein the sheet of material 20 is anchored to the upper support surface 16*a* of the support member 14*a*; the sheet of material 20 being upwardly gathered and joined to enclose the floral grouping 12 which is supported within a bed of growth material 32 such as previously discussed and shown in FIGS. 4 and 5.

Figure 12:
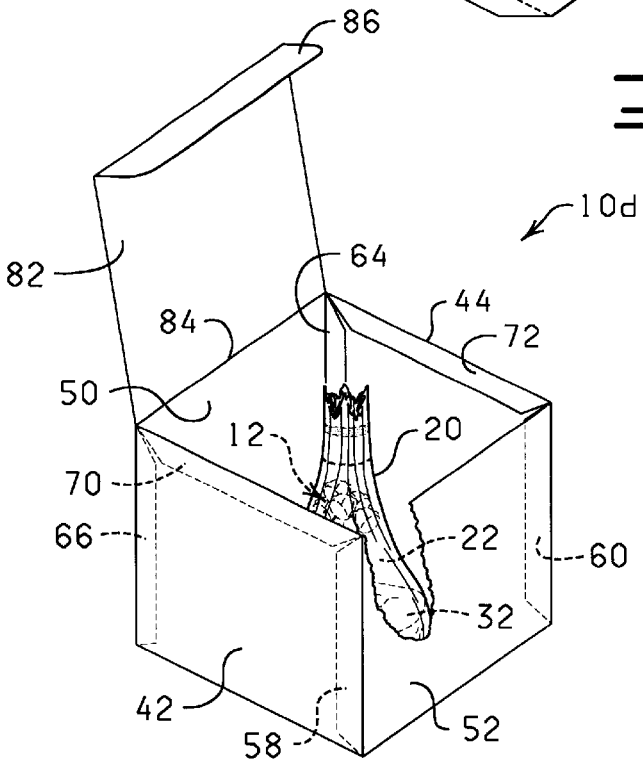
FIG. 12 is a perspective view of the packaging assembly of FIG. 11 in a fully-folded condition wherein the support member circumscribes the floral grouping.

FIG. 12 shows the fully folded position of the wall portions 42, 44, 50, 52 which together form a wall circumscribing the sheet of material 20 and the contents within the cavity 22 formed by the upwardly folded and joined sheet of material 20. The wall portion 52 has a pair of opposing tabs 58, 60 that are folded inwardly along fold lines 62, 64, respectively, to supportingly attach to the adjacent wall portions 42, 44. In a like manner, wall portion 50 has tabs 66, 68 that fold inwardly along fold lines 70, 72 to supportingly attach to the adjacent wall portions 42, 44. The wall portions 42, 44 have distal tabs 74, 76 which fold inwardly along fold lines 78, 80 to double over and attach to the wall portions 42, 44 to stiffen the wall portions 42, 44 and to trap the tabs 66, 68 of the wall portion 50 and the tabs 58, 60 of the wall portion 52. A bonding material, as previously described, can be employed to attach the tabs.

The support member 14*a* further has a cover 82 that folds toward the upper support surface 16*a* along fold line 84, and a distal tab 86 that folds inwardly along fold line 88. The cover 82 and distal tab 86 matingly engage the plurality of wall portions 42, 44, 50, 52 to substantially enclose the wrapper of the sheet of material 20 and the contents within the cavity 22 thereof. By interposing the sheet of material 20 between the support member 14*a* and the floral grouping 12, the support member 14*a* is isolated from moisture associated with the floral grouping 12 in the cavity 22. As such, the support member 14*a* can be provided of a non-waterproof material, such as corrugated paper or cardboard. In this manner, the support member 14*a* provides a structurally supporting outer enclosure about the floral grouping 12 and the sheet of material 20 provides a substantially water tight inner enclosure.

It should be understood that changes may be made in the construction and operation of the various components and assemblies described herein and changes may be made in the steps or the sequence of steps of the methods described herein without departing from the spirit and the scope of the invention as defined in the following claims.

What is claimed is:

1. A packaging assembly, comprising:

a floral grouping;

a sheet of material having an upper surface and a lower surface, the sheet of material having an outer portion wrapped and secured about the floral grouping to enclose the floral grouping within the sheet of material; and a support member having an upper support surface and a lower surface, wherein a medial portion of the lower surface of the sheet of material is attached to the upper support surface of the support member so that the sheet of material and the support member support the floral grouping in a desired position to prevent movement of the floral grouping relative to the support member during transport of the packaging assembly, wherein the sheet of material is attached to the support member with a bonding material interposed therebetween.

2. The packaging assembly of claim 1 wherein the bonding material is selected from the group consisting of cohesives, adhesives, and combinations thereof.

3. A packaging assembly, comprising:

a floral grouping;

a sheet of material having an upper surface and a lower surface, the sheet of material having an outer portion wrapped and secured about the floral grouping to enclose the floral grouping within the sheet of material; and a support member having an upper support surface and a lower surface, wherein a medial portion of the lower surface of the sheet of material is attached to the upper support surface of the support member so that the sheet of material and the support member support the floral grouping in a desired position to prevent movement of the floral grouping relative to the support member during transport of the packaging assembly, wherein the support member comprises a wall circumscribing the floral grouping with the sheet of material interposed between the wall and the floral grouping.

4. The packaging assembly of claim 3 wherein the support member further comprises a cover that matingly engages the wall to enclose the floral grouping with the sheet of material interposed between the floral grouping and the support member.

5. The packaging assembly of claim 3 wherein the support member further comprises a foldable cover that cooperates with the wall and the upper support surface to form an outer enclosure about the floral grouping with the sheet of material interposed between the floral grouping and the other enclosure, the sheet of material providing a substantially water tight inner enclosure about the floral grouping.

6. A shipping package for a floral grouping, comprising:

a support member having an upper support surface and a lower surface; and a sheet of material having an upper surface and a lower surface wherein a medial portion of the lower surface of the sheet of material is attached to the upper support surface of the support member to anchor the sheet of material while an outer portion of the sheet of material extending radially from the medial portion of the sheet of material is adapted for wrapping about and enclosing the floral grouping so that the support member in combination with the sheet of material supports the floral grouping in a substantially upright position during transport of the shipping package, wherein the sheet of material is attached to the support member with a bonding material interposed therebetween the medial portion of the sheet of material and the upper support surface of the support member.

7. The shipping package of claim 6 wherein the bonding material is selected from the group consisting of cohesives, adhesives, and combinations thereof.

8. A shipping package for a floral grouping, comprising:

a support member having an upper support surface and a lower surface; and a sheet of material having an upper surface and a lower surface wherein a medial portion of the lower surface of the sheet of material is attached to the upper support surface of the support member to anchor the sheet of material while an outer portion of the sheet of material extending radially from the medial portion of the sheet of material is adapted for wrapping about and enclosing the floral grouping so that the support member in combination with the sheet of material supports the floral grouping in a substantially upright position during transport of the shipping package, wherein the support member comprises a wall circumscribing the floral grouping with the sheet of material interposed between the wall and the floral grouping, and wherein the support member comprises a plurality of foldable extending portions adaptable for folding along a plurality of fold lines toward the upper support surface of the support member to form a plurality of upstanding wall portions, and wherein adjacent upstanding wall portions have interlocking tabs to join adjacent wall portions to form the wall.

9. The shipping package of claim 8, wherein the support member further comprises a cover that matingly engages the wall of enclose the floral grouping with the sheet of material interposed between the floral grouping and the support member.

* * * * *

UNITED STATES PATENT AND TRADEMARK OFFICE

CERTIFICATE OF CORRECTION

PATENT NO. : 6,604,632 B2
DATED : August 12, 2003
INVENTOR(S) : Donald E. Weder

It is certified that error appears in the above-identified patent and that said Letters Patent is hereby corrected as shown below:

Column 4,
Line 45, word “lob” should be number -- 10b --.

Column 7,
Line 39, word “other” should be word -- outer --.

Column 8,
Line 43, after word “wall” and before word “enclose” change word “of” to word -- to --.

Signed and Sealed this

Eighteenth Day of January, 2005

JON W. DUDAS
*Director of the United States Patent and Trademark Office*